US007234983B2

(12) United States Patent
Davis

(10) Patent No.: US 7,234,983 B2
(45) Date of Patent: Jun. 26, 2007

(54) PROTECTIVE MARINE VESSEL AND DRIVE

(75) Inventor: Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 19 days.

(21) Appl. No.: 11/255,718

(22) Filed: Oct. 21, 2005

(65) Prior Publication Data

US 2007/0093150 A1 Apr. 26, 2007

(51) Int. Cl.
*B63H 5/16* (2006.01)

(52) U.S. Cl. ..... 440/68; 440/69; 440/70

(58) Field of Classification Search ..... None
See application file for complete search history.

(56) References Cited

U.S. PATENT DOCUMENTS 2,393,234 A * 1/1946 Burgess ..... 114/163
4,383,828 A * 5/1983 Wynne ..... 440/69
4,907,994 A * 3/1990 Jones ..... 440/61 R
5,108,325 A 4/1992 Livingston et al.
5,230,644 A 7/1993 Meisenburg et al.
5,277,632 A * 1/1994 Davis ..... 440/71
5,366,398 A 11/1994 Meisenburg et al.
5,386,368 A 1/1995 Knight
5,403,216 A 4/1995 Salmi et al.
5,415,576 A 5/1995 Meisenburg et al.
5,425,663 A 6/1995 Meisenburg et al.
5,685,253 A 11/1997 Alexander, Jr.
5,735,718 A 4/1998 Ekwall
5,755,605 A 5/1998 Äsberg
6,138,601 A 10/2000 Anderson et al.
6,142,841 A 11/2000 Alexander et al.
6,230,642 B1 5/2001 McKenney et al.
6,234,853 B1 5/2001 Lanyi et al.
6,354,235 B1 3/2002 Davies
6,357,375 B1 3/2002 Ellis
6,386,930 B2 5/2002 Moffet
6,431,928 B1 8/2002 Aarnivuo
6,439,937 B1 8/2002 Mansson et al.
6,447,349 B1 9/2002 Fadeley et al.
6,511,354 B1 1/2003 Gonring et al.

(Continued)

FOREIGN PATENT DOCUMENTS

WO WO 03/072431 2/2003

(Continued)

OTHER PUBLICATIONS

Marine Technology Society Dynamic Positioning Committee Conference Thrusters Session entitled Compact Azipod® Propulsion on DT Supply Vessels, presented by Strand et al, held in Oslo, Norway, Sep. 18-19, 2001.

(Continued)

*Primary Examiner*—Jesus Sotelo
*Assistant Examiner*—Daniel V. Venne
(74) *Attorney, Agent, or Firm*—Andrus, Sceales, Starke & Sawall, LLP

(57) ABSTRACT

A marine vessel and drive combination includes port and starboard tunnels formed in a marine vessel hull raising port and starboard steerable marine propulsion devices to protective positions relative to the keel.

4 Claims, 11 Drawing Sheets

U.S. PATENT DOCUMENTS

| | | | |
|---|---|---|---|
| 6,582,259 | B1 | 6/2003 | Mansson et al. |
| 6,623,320 | B1 | 9/2003 | Hedlund |
| 6,638,124 | B2 | 10/2003 | Zoubul et al. |
| 6,688,927 | B2 | 2/2004 | Aarnivuo |
| 6,705,907 | B1 | 3/2004 | Hedlund |
| 6,712,654 | B1 | 3/2004 | Putaansuu |
| 6,783,410 | B2 | 8/2004 | Florander et al. |
| 6,942,531 | B1 | 9/2005 | Fell et al. |
| 6,952,180 | B2 | 10/2005 | Jonsson et al. |
| 2002/0197918 | A1 | 12/2002 | Aarnivuo |
| 2003/0161730 | A1 | 8/2003 | Rydberg |
| 2003/0166362 | A1 | 9/2003 | Varis |
| 2003/0230636 | A1 | 12/2003 | Varis |
| 2004/0014380 | A1 | 1/2004 | Varis et al. |
| 2004/0149003 | A1 | 8/2004 | Nestvall |
| 2004/0214484 | A1 | 10/2004 | Ylitalo |

FOREIGN PATENT DOCUMENTS

| | | |
|---|---|---|
| WO | WO 03/074355 | 3/2003 |
| WO | WO 03/093102 | 4/2003 |
| WO | WO 03/093105 | 4/2003 |
| WO | WO 03/093106 | 4/2003 |
| WO | WO 03/093107 | 4/2003 |
| WO | WO 03/042036 | 5/2003 |
| WO | WO 2004/068082 | 1/2004 |
| WO | WO 2004/074089 | 2/2004 |
| WO | WO 2004/113162 | 4/2004 |

OTHER PUBLICATIONS

Marine Technology Society Dynamic Positioning Committee Conference Thrusters Session entitled New Thruster Concept for Station Keeping and Electric Propulsion, presented by Adnanes et al, held in Helsinki, Finland, Sep. 18-19, 2001.

Department of Marine Technology, Norwegian University of Science and Technology, presentation entitled Dynamically Positioned and Thruster Assisted Positioned Moored Vessels, presented by Professor Asgeir J. Sorensen, held in Trondheim, Norway.

Dec. 2004 Boating Business article entitled Volvo: Changing Boating Forever.

Jan. 2005 Boating Magazine article by David Seidman entitled Short Shafted.

OXTS Inertial+GPS; OXTS—Oxford Technical Solutions—RT3040 (http://oxts.com/product) last visited Sep. 30, 2005.

* cited by examiner

PROTECTIVE MARINE VESSEL AND DRIVE

BACKGROUND AND SUMMARY

The invention relates to marine vessel and drive combinations.

Marine vessels having a drive unit extending downwardly through the hull are known in the prior art, for example a Mercury Marine L-drive as shown in U.S. Pat. No. 5,108,325, a Volvo IPS (inboard propulsion system) drive, and ABB (Asea Brown Bavaria) aziod drives.

The present invention arose during continuing development efforts related to marine vessel and drive combinations.

DETAILED DESCRIPTION

Figure 1:
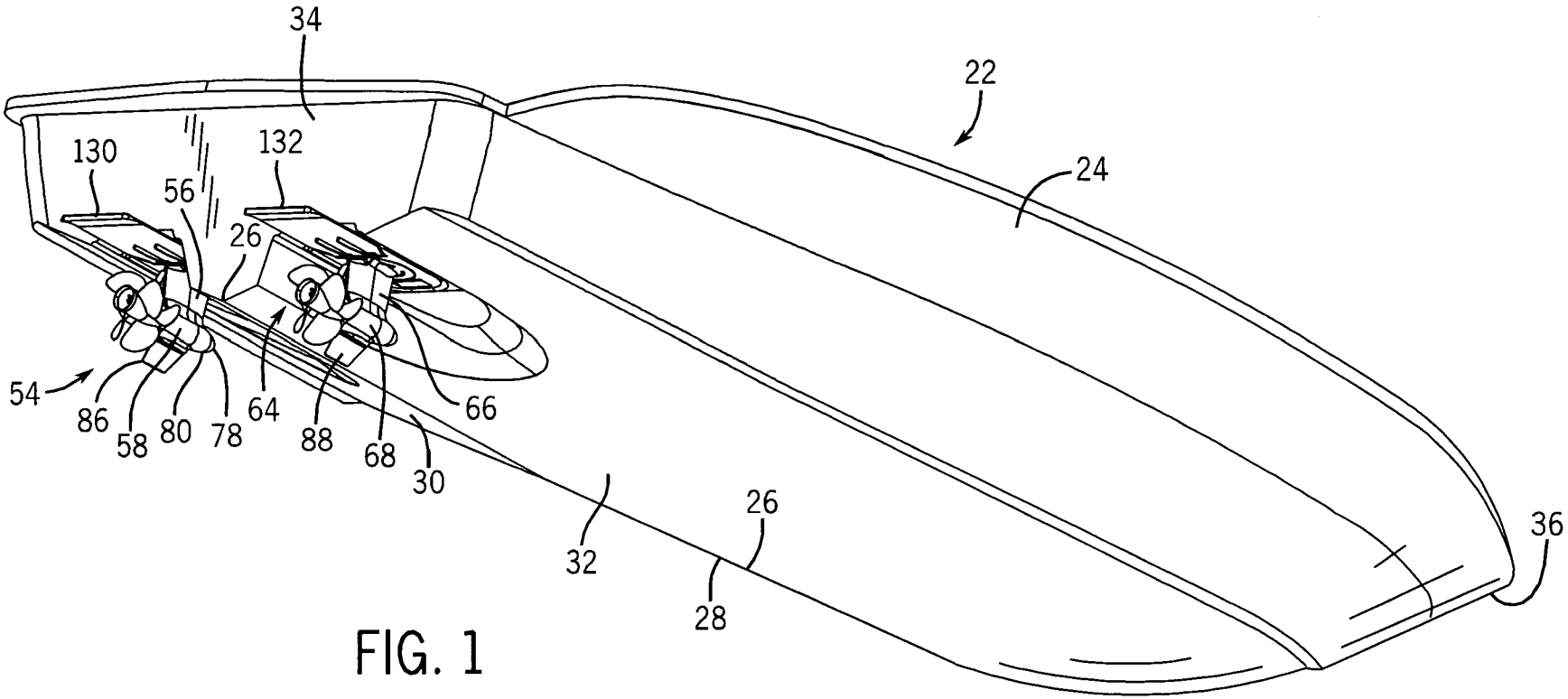
FIG. 1 is a perspective view of a marine vessel and drive combination in accordance with the invention.

FIGS. 1–4 show a marine vessel and drive combination. Marine vessel 22 includes a hull 24 having a longitudinally extending keel 26 having a lower reach 28. The hull has port and starboard lower hull surfaces 30 and 32, respectively, extending upwardly and laterally distally oppositely from keel 26 in V-shaped relation, FIG. 4. Hull 24 extends forwardly from a stern 34 to a bow 36.

Figure 2:
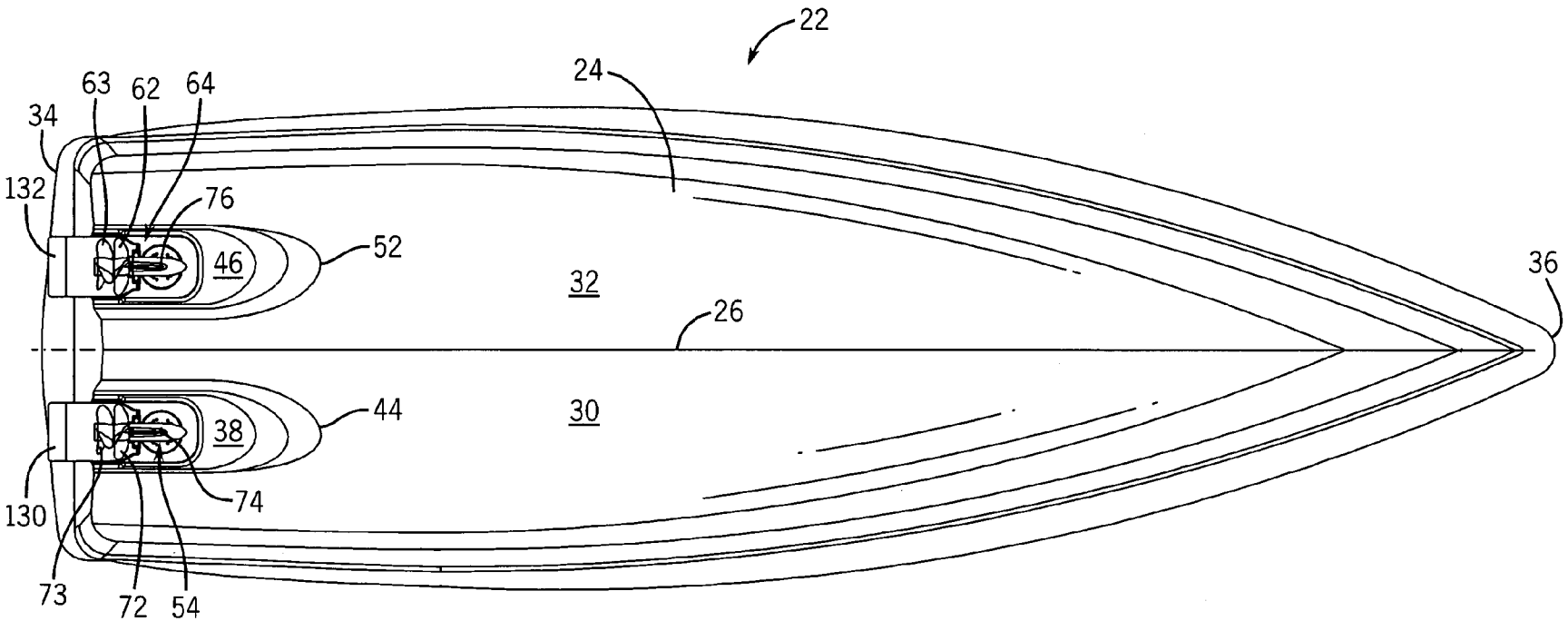
FIG. 2 is a bottom elevation view of the combination of FIG. 1.
Figure 3:
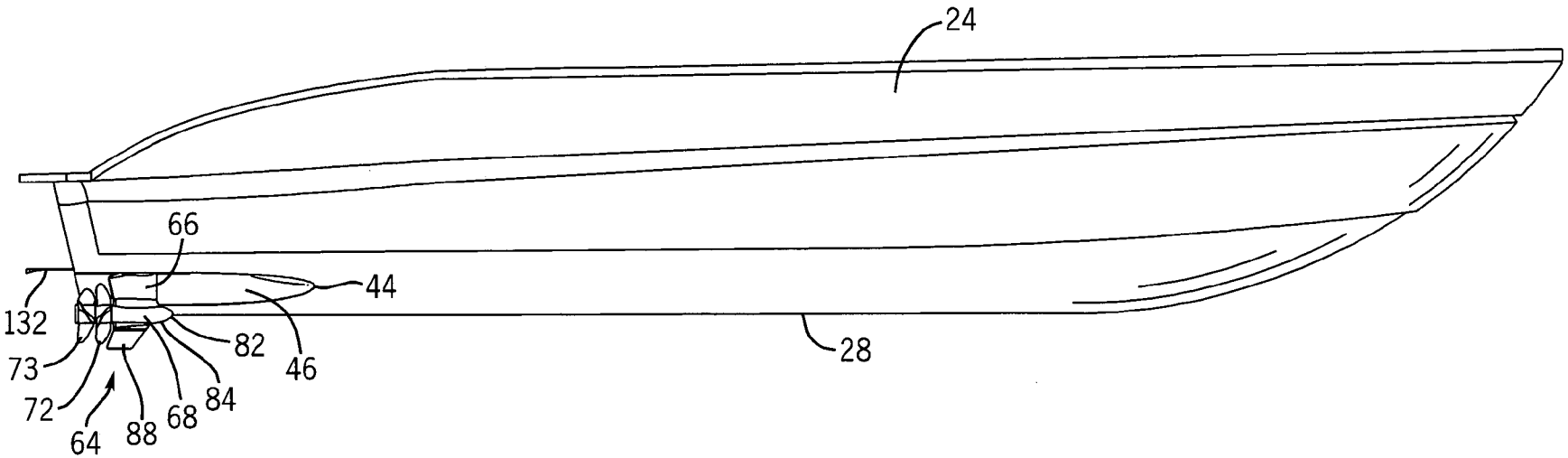
FIG. 3 is a side elevation view of the combination of FIG. 1.

A port tunnel 38, FIG. 2 is formed in port lower hull surface 30. Port tunnel 38 has a top 40, FIG. 4, spaced above an open bottom 42 at port lower hull surface 30. Port tunnel 38 opens aft at stern 34 and extends forwardly therefrom and has a closed forward end 44 aft of bow 36. A starboard tunnel 46 is formed in starboard lower hull surface 32. Starboard tunnel 46 has a top 48 spaced above an open bottom 50 at starboard lower hull surface 32. Starboard tunnel 46 opens aft at stern 34 and extends forwardly therefrom and has a closed forward end 52 aft of bow 36.

A port marine propulsion device 54 includes a port driveshaft housing 56 extending downwardly in port tunnel 38 to a port lower gear case 58, e.g. including a torpedo-shaped housing as is known, supporting at least one port propeller shaft 60 driving at least one water-engaging propulsor such as port propeller 62, and preferably a pair of propeller shafts driving counter-rotating propellers 62, 63, as is known, for example U.S. Pat. Nos. 5,108,325, 5,230,644, 5,366,398, 5,415,576, 5,425,663, all incorporated herein by reference. Starboard marine propulsion device 64 is comparable and includes a starboard driveshaft housing 66 extending downwardly in starboard tunnel 46 to starboard lower gear case 68, e.g. provided by the noted torpedo-shaped housing, supporting at least one starboard propeller shaft 70 driving at least one starboard propeller 72, and preferably a pair of counter-rotating starboard propellers 72, 73, as above. The port and starboard marine propulsion devices 54 and 64 are steerable about respective port and starboard vertical steering axes 74 and 76, comparably as shown in commonly owned co-pending U.S. patent application No. 11/248,482, filed Oct. 12, 2005, and application Ser. No. 11/248,483, filed Oct. 12, 2005, incorporated herein by reference. Port steering axis 74 extends through the top 40 of port tunnel 38. Starboard steering axis 76 extends through the top 48 of the starboard tunnel 46.

Figure 4:
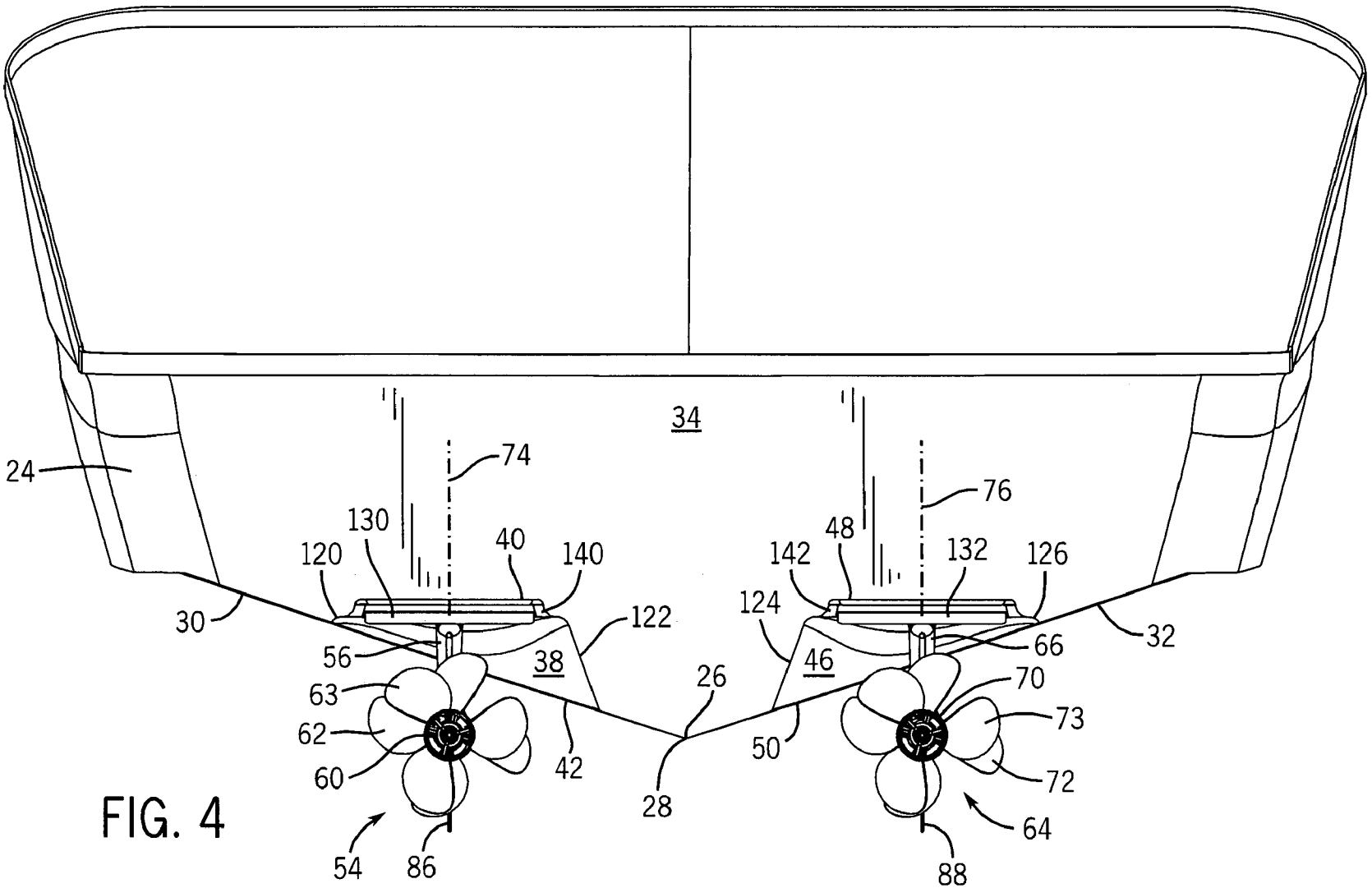
FIG. 4 is an enlarged view of a portion of FIG. 3.
Figure 5:
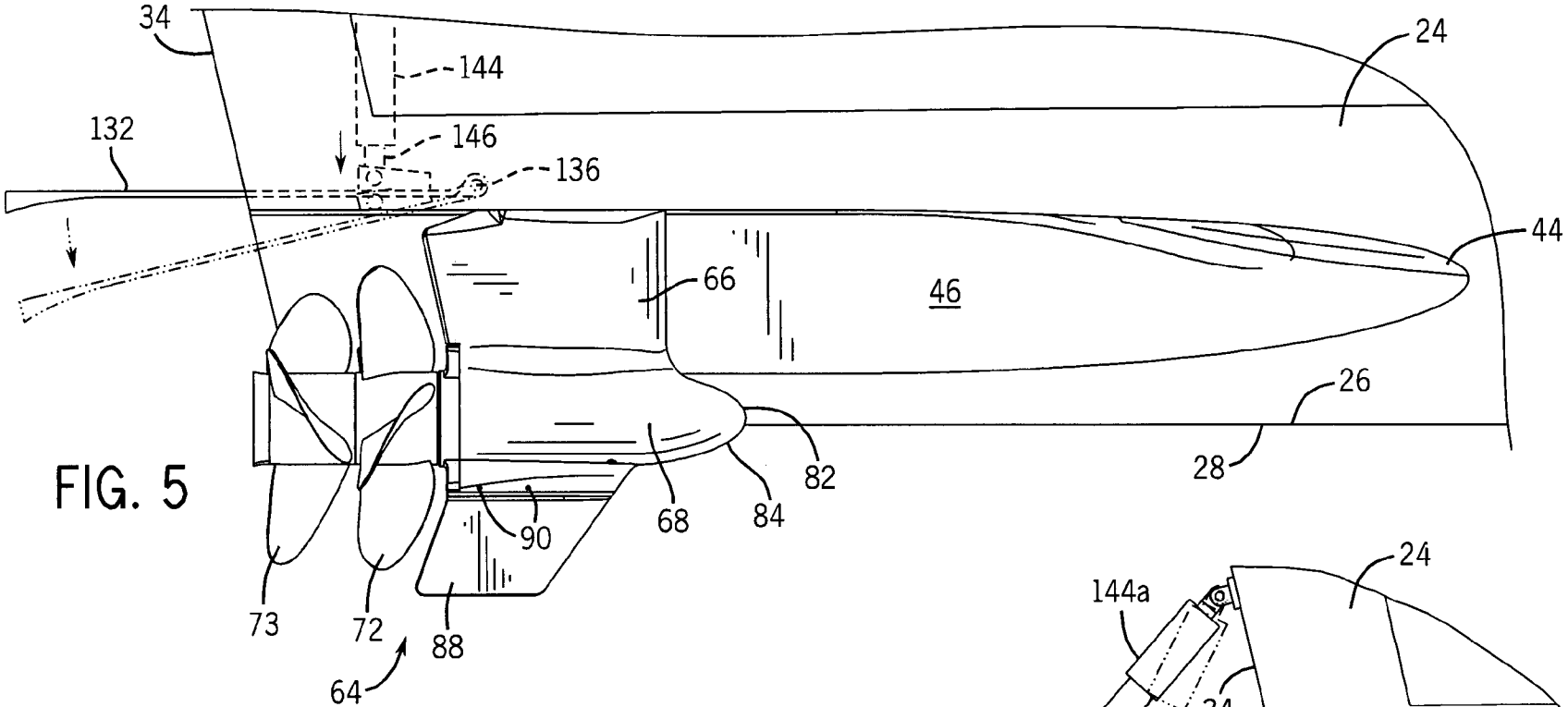
FIG. 5A is a like a portion of FIG. 5 and shown an alternate embodiment.
FIG. 5B is an enlarged rear elevation view of a portion of FIG. 5.
Figure 5A:
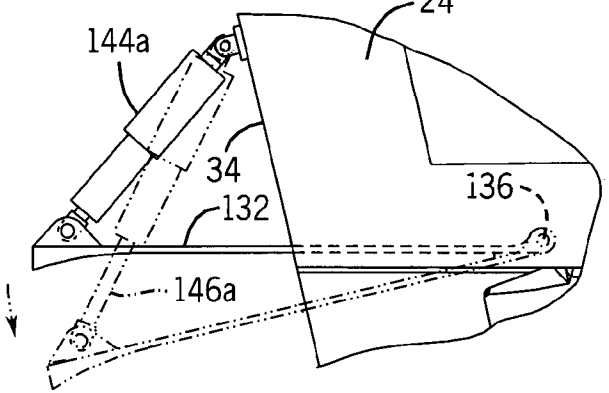
Figure 5B:
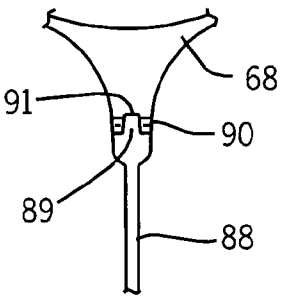

Tops 40 and 48 of port and starboard tunnels 38 and 46 are at a given vertical elevation, FIG. 4, spaced vertically above lower reach 28 of keel 26 to provide port and starboard tunnels 38 and 46 with a given vertical height receiving port and starboard marine propulsion devices 54 and 64 and raising same relative to keel 26, such that keel 26 at least partially protects port and starboard marine propulsion devices 54 and 64 from striking underwater objects, including grounding, during forward propulsion of the vessel. At least a portion of port driveshaft housing 56 is in port tunnel 38 and above open bottom 42 of port tunnel 38 at port lower hull surface 30. At least a portion of port lower gear case 58 is outside of port tunnel 38 and below open bottom 42 of port tunnel 38 at port lower hull surface 30. At least a portion of starboard driveshaft housing 66 is in starboard tunnel 46 and above open bottom 50 of starboard tunnel 46 at starboard lower hull surface 32. At least a portion of starboard lower gear case 68 is outside of starboard tunnel 46 and below open bottom 50 of starboard tunnel 46 at starboard lower hull surface 32. In one preferred embodiment, port and starboard lower gear cases 58 and 68 are horizontally aligned along a horizontal projection line at or above and transversely crossing lower reach 28 of keel 26. Port lower gear case 58 includes the noted port torpedo-shaped housing having a front nose 78 with a curved surface 80 extending downwardly and aft therefrom. In one preferred embodiment, front nose 78 is horizontally aligned with lower reach 28 of keel 26, such that underwater objects struck by port lower gear case 58 slide along curved surface 80 downwardly and aft from nose 78 of the noted port torpedo-shaped housing. Starboard lower gear case 68 includes the noted starboard torpedo-shaped housing having a front nose 82, FIG. 5, with a curved surface 84 extending downwardly and aft therefrom. In the noted one preferred embodiment, front nose 82 is horizontally aligned with lower reach 28 of keel 26, such that underwater objects struck by starboard lower gear case 68 slide along curved surface 84 extending downwardly and aft from nose 82 of the noted starboard torpedo-shaped housing. Further in the noted preferred embodiment, port and starboard marine propulsion devices 54 and 64 have respective port and starboard lower skegs 86 and 88 extending downwardly from respective port and starboard lower gear cases 58 and 68 to a lower reach at a vertical level below lower reach 28 of keel 26. Each of port and starboard lower skegs 86 and 88 is a breakaway skeg, e.g. mounted by frangible shear pins such as 90, FIG. 5, to its respective lower gear case, and breaking away from its respective lower gear case upon striking an underwater object, to protect the respective marine propulsion device. FIG. 5B is an enlarged rear elevational view of a portion of skeg 88 and gear case 68 of FIG. 5, with propellers 72 and 73 removed, and showing the mounting of skeg 88 to lower gear case 68 by a breakaway channel or tongue and groove arrangement, for example tongue 89 at the top of the skeg 88, and groove or channel 91 at the bottom of lower gear case 68 receiving tongue 89 in breakaway manner upon shearing of frangible pins such as 90.

Figure 6:
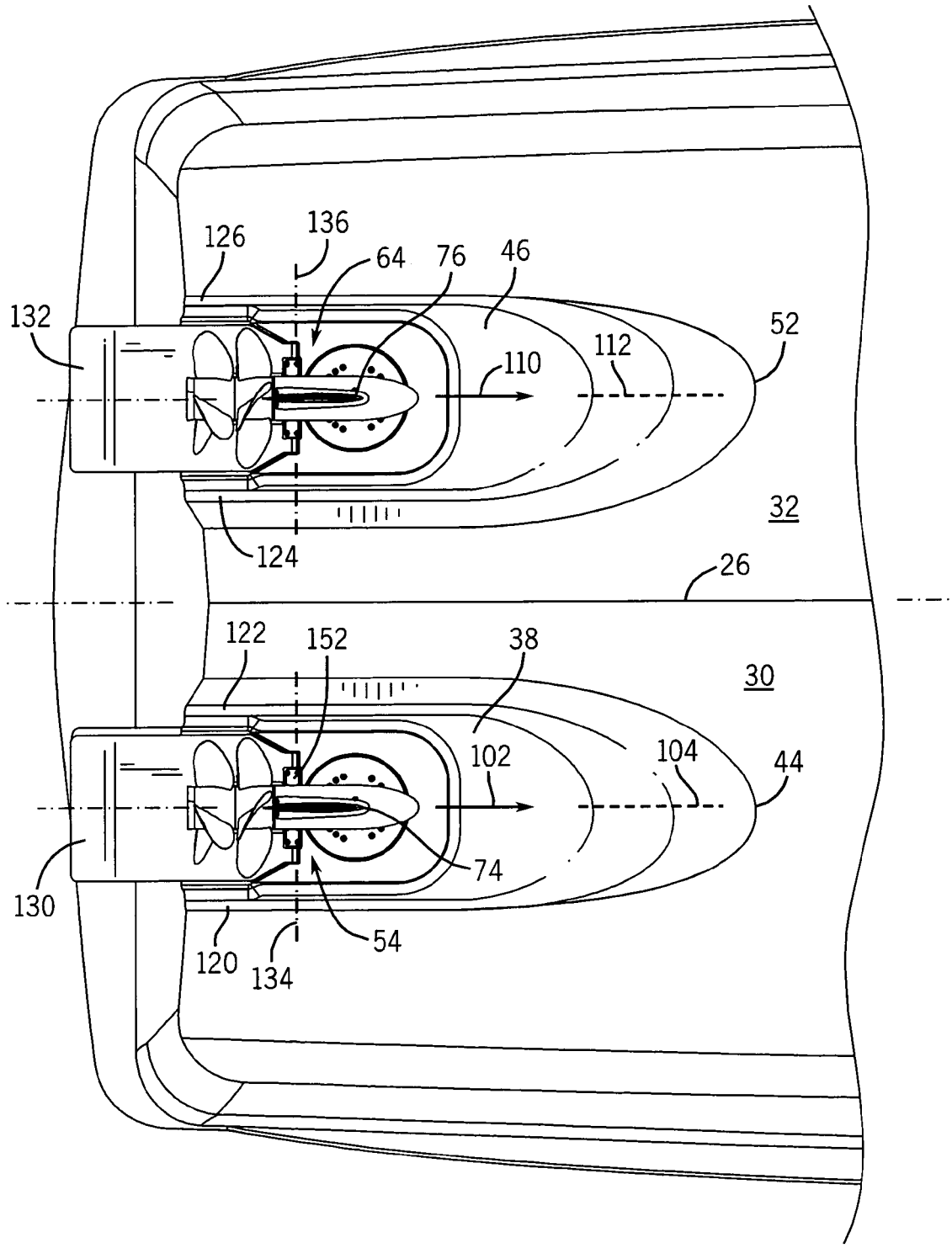
FIG. 6 is an enlarged view of a portion of FIG. 2.
Figure 7:
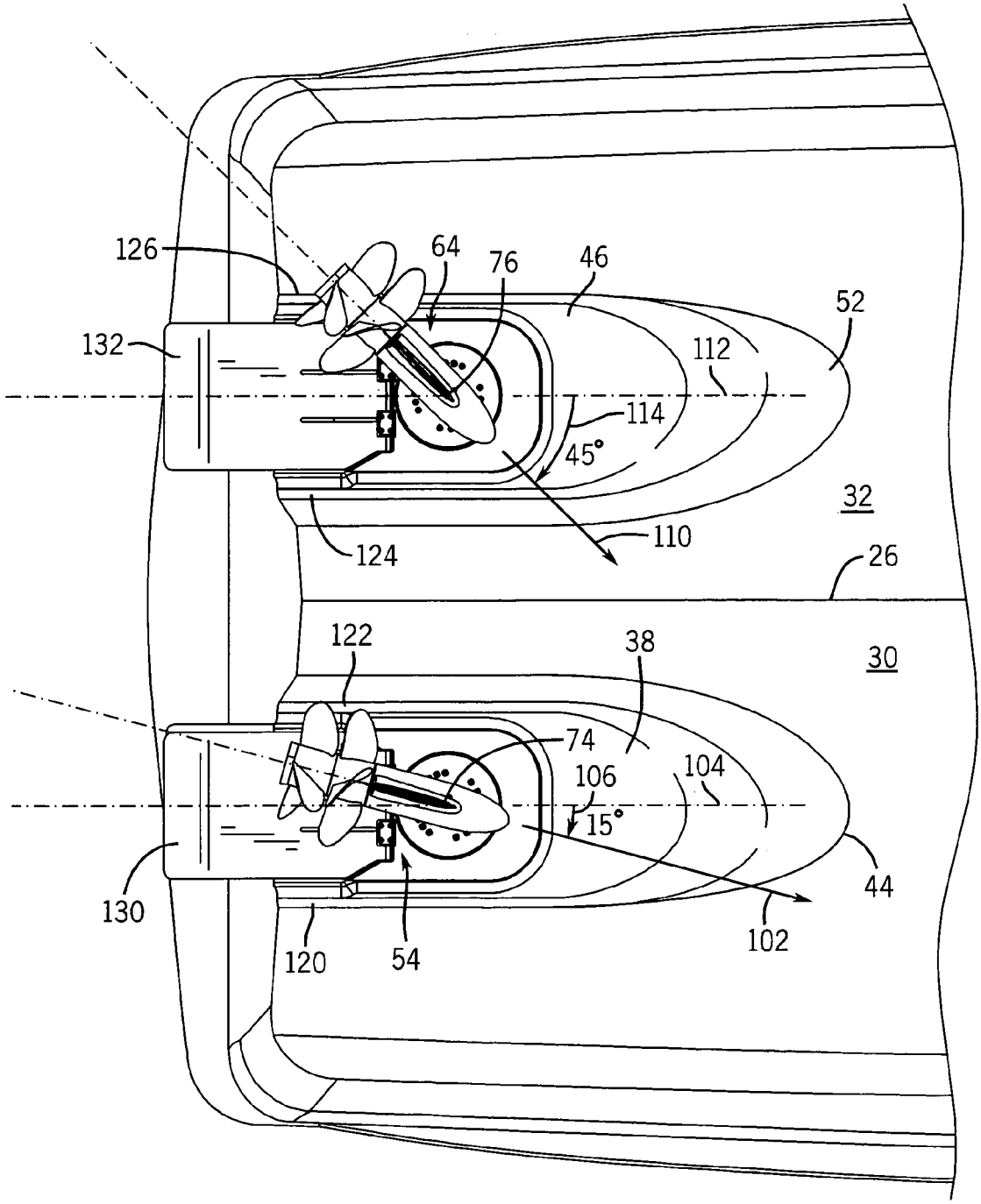
FIG. 7 is like FIG. 6 and shows a different steering orientation.
Figure 8:
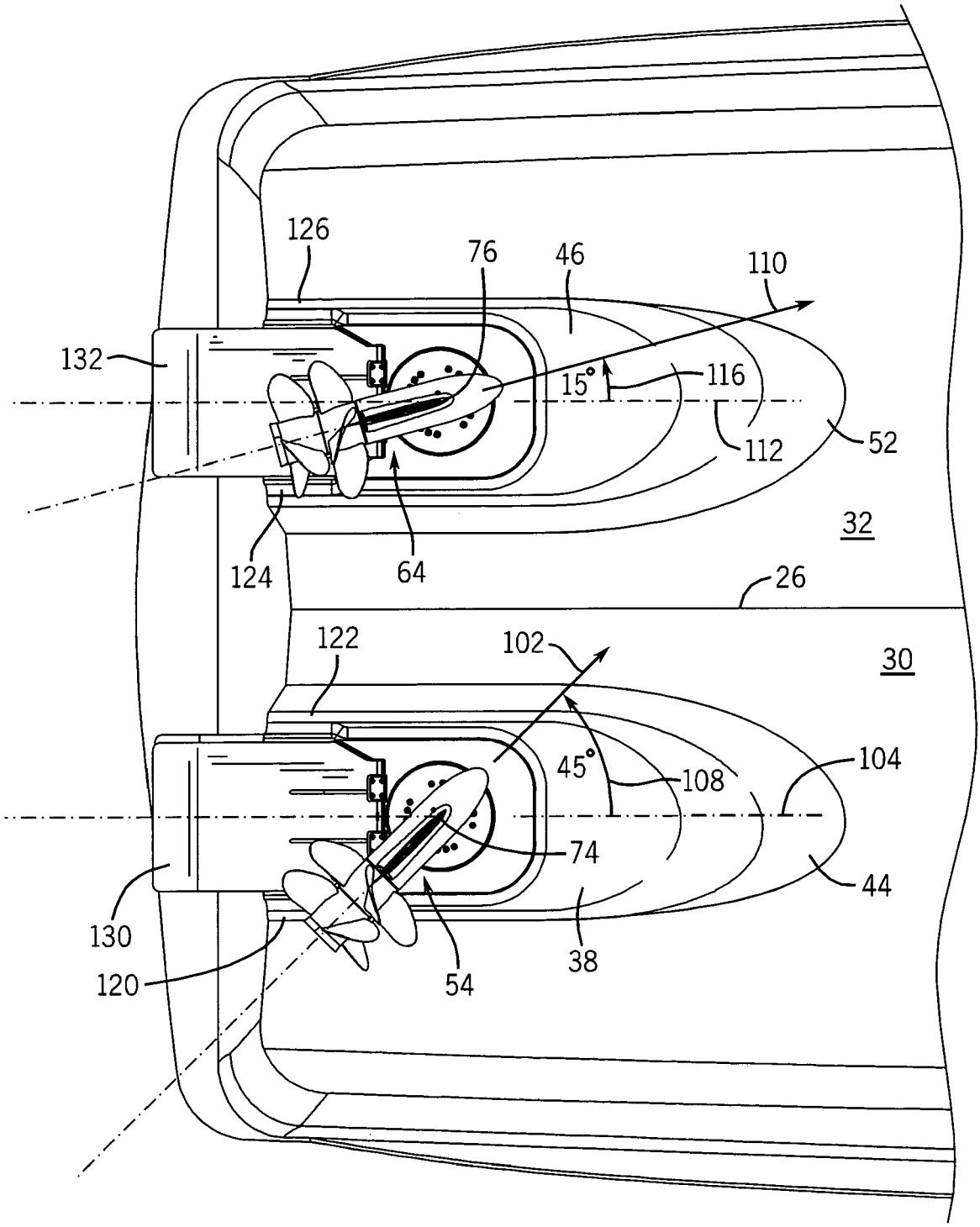
FIG. 8 is like FIG. 6 and shows another different steering orientation.

Port marine propulsion device 54 provides propulsion thrust along a port thrust direction 102, FIG. 6, along the noted at least one port propeller shaft 60. Port marine propulsion device 54 has a port reference positions 104 with port thrust direction 102 pointing forwardly parallel to keel 26. Port marine propulsion device 54 is steerable about port steering axis 74 along a first angular range 106, FIG. 7, from port reference position 104 away from keel 26, e.g. clockwise in FIG. 7. Port marine propulsion device 54 is steerable about steering axis 72 along a second angular range 108, FIG. 8, from port reference position 104 towards keel 26, e.g. counterclockwise in FIG. 8. Angular ranges 106 and 108 are unequal, and port tunnel 38 is asymmetric, to be described. Starboard propulsion device 64 provides propulsion thrust along a starboard thrust direction 110 along the noted at least one starboard propeller shaft 70. Starboard marine propulsion device 64 has a starboard reference position 112, FIG. 6, with starboard thrust direction 110 pointing forwardly parallel to keel 26. Starboard marine propulsion device 64 is steerable about starboard steering axis 76 along a third angular range 114, FIG. 7, from starboard reference position 112 towards keel 26, e.g. clockwise in FIG. 7. Starboard marine propulsion device 64 is steerable about starboard steering axis 76 along a fourth angular range 116, FIG. 8, away from keel 26, e.g. counterclockwise in FIG. 8. Third and fourth angular ranges 114 and 116 are unequal, and starboard tunnel 46 is asymmetric, to be described. In one preferred embodiment, second angular range 108 is at least twice as great as first angular range 106, and in a further preferred embodiment, first angular range 106 is at least 15 degrees, and second angular range 108 is at least 45 degrees. In the noted preferred embodiment, third angular range 114 is at least twice as great as fourth angular range 116, and in the noted further preferred embodiment, third angular range 114 is at least 45 degrees, and fourth angular range 116 is at least 15 degrees. Marine propulsion devices 54 and 64 may be rotated and steered in unison with equal angular ranges, or may be independently controlled for various steering, docking, and position or station maintaining virtual anchoring functions, an for which further reference is made to the above-noted commonly owned co-pending '482 and '483 applications.

Port tunnel 38 has left and right port tunnel sidewalls 120 and 122 extending vertically between top 40 of port tunnel 38 and open bottom 42 of port tunnel 38 and port lower hull surface 30. Left and right port tunnel sidewalls 120 and 122 are laterally spaced by port driveshaft housing 56 therebetween. Right port tunnel sidewall 122 has a greater vertical height and a lower vertical reach than left port tunnel sidewall 120 and limits the span of first angular range 106 to be less than the span of second angular range 108. Starboard tunnel 46 has left and right starboard tunnel sidewalls 124 and 126 extending vertically between top 48 of the starboard tunnel 46 and open bottom 50 of starboard tunnel 46 at starboard lower hull surfaces 32. Left and right starboard tunnel sidewalls 124 and 126 are laterally spaced by starboard driveshaft housing 66 therebetween. Left starboard tunnel sidewall 124 has a greater vertical height and a lower vertical reach than right starboard tunnel sidewall 126 and limits the span of fourth angular range 116 to be less than the span of third angular range 114.

Figure 9:
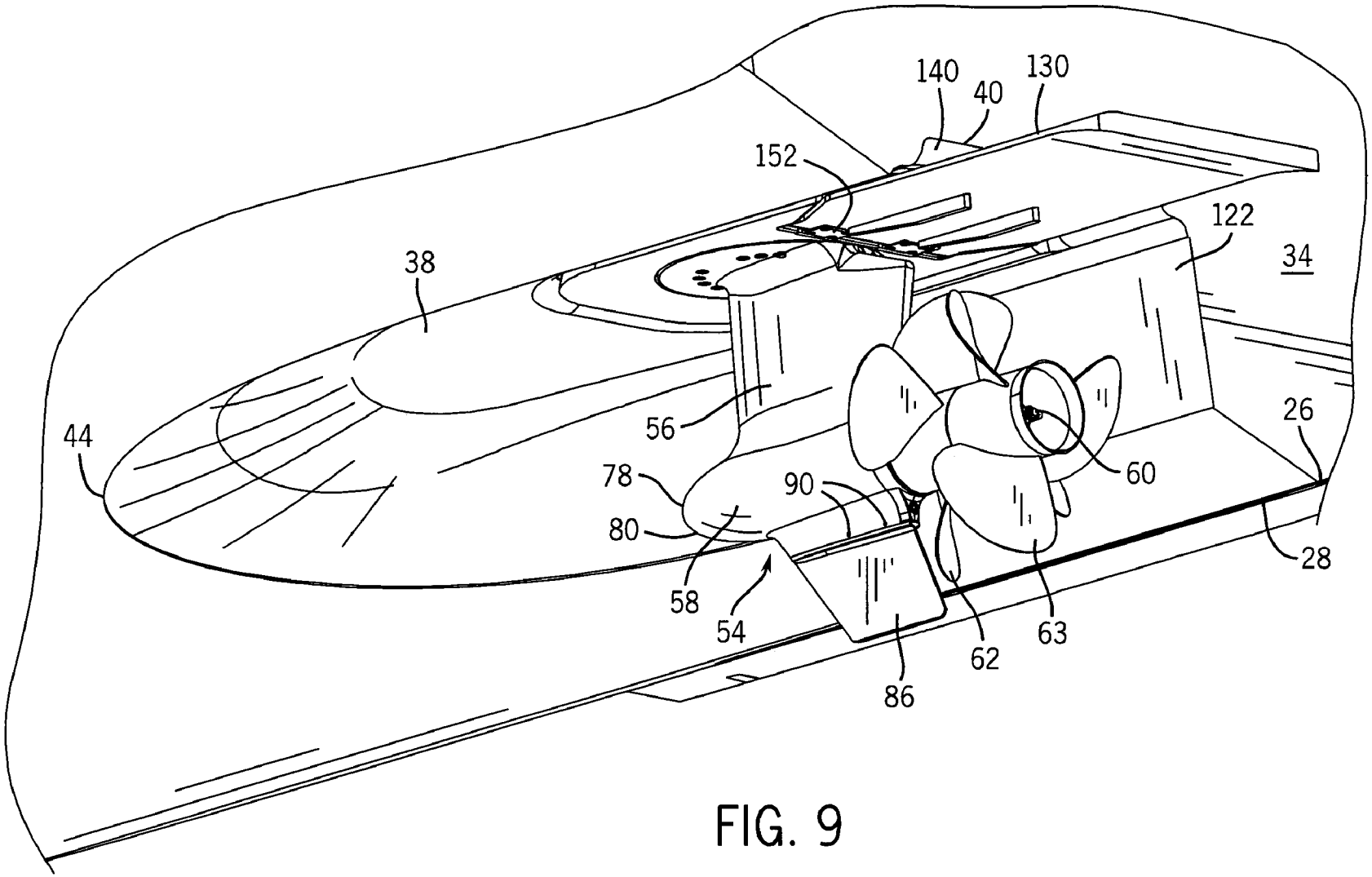
FIG. 9 is an enlarged view of a portion of FIG. 1.
Figure 10:
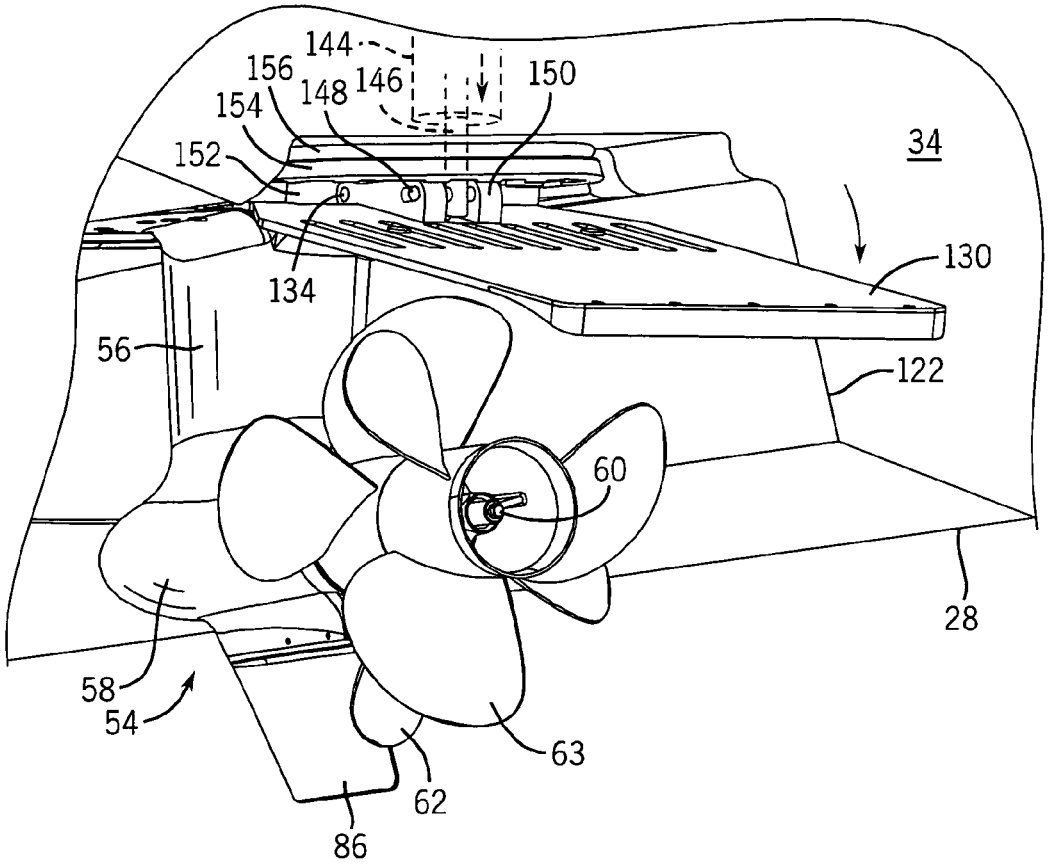
FIG. 10 is like FIG. 9 and shows a further operational embodiment.

Port marine propulsion device 54 has a port trim tab 130 pivotally mounted thereto for contact by the water for adjusting vessel attitude and/or altering thrust vector or otherwise affecting hydrodynamic operation of the vessel. Starboard marine propulsion device 64 has a starboard trim tab 132 pivotally mounted thereto. Port trim 130 is preferably pivotally mounted to port marine propulsion device 54 at a pivot axis 134, FIG. 6, aft of port driveshaft housing 56 and aft of port steering axis 74. Likewise, starboard trim tab 132 is preferably pivotally mounted to starboard marine propulsion device 64 at a pivot axis 136 aft of starboard driveshaft housing 66 and aft of starboard steering axis 76. Port trim tab 130 has an upwardly pivoted retracted position, FIGS. 1, 4, 9, and solid line in FIG. 5, and a downwardly pivoted extended position, FIG. 10, and dashed line in FIG. 5. The top 40, FIG. 4, of port tunnel 38 has a notch 140 receiving port trim tab 130 in the noted retracted position to enhance hydrodynamic profile by providing a smoother transition providing less restriction to water flow therepast. Starboard trim tab 132 likewise has an upwardly pivoted retracted position, and a downwardly pivoted extended position. The top 48 of starboard position to enhance hydrodynamic profile. Each trim tab may be actuated in conventional manner, e.g. hydraulically, e.g., by a hydraulic cylinder 144 having an extensible and retractable plunger or piston 146 engaging pivot pin 148 journaled to stanchions 150 of the respective trim tab. In an alternate embodiment, FIG. 5A, external hydraulic cylinder **144*a* has its piston 146*a* connected to the aft end of the trim tab, for a longer moment arm from the pivot axis of the trim tab if desired. In further embodiments, the trim tabs may be actuated electrically, e.g. by electrical reduction motors. The forward end of the trim tab is pivotally mounted at hinges such as 152 to mounting plate 154 of the marine propulsion device which is then mounted to the vessel hull and selected thereto for example at sealing gasket 156**. In the preferred embodiment, the forward end of the trim tab is pivotally mounted to the marine propulsion device and not to the vessel, and the aft end of the trim tab is movable in a vertical arc.

Figure 11:
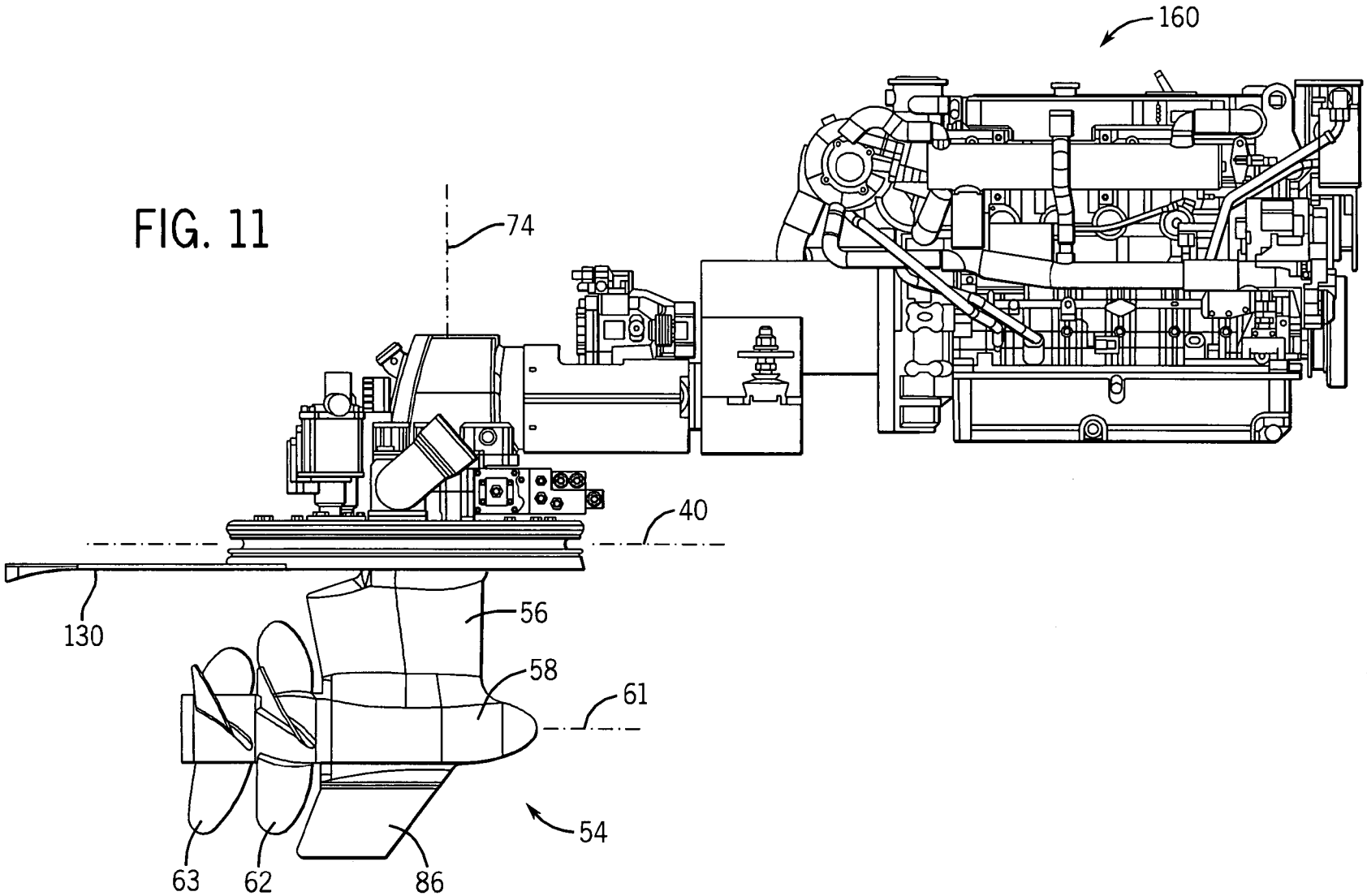
FIG. 11 is a side view showing the arrangement of an engine and marine propulsion device used in conjunction with the present invention.

FIG. 11 is a side view taken from the above-noted commonly owned co-pending '482 and '483 applications and showing the arrangement of a marine propulsion device, such as 54 or 64, associated with a mechanism that is able to rotate the marine propulsion device about its respective steering axis 74 or 76. Although not visible in FIG. 11, the driveshaft of the marine propulsion device extends vertically and parallel to the steering axis and is connected in torque transmitting relation with a generally horizontal propeller shaft that is able to rotate about a propeller axis 61. The embodiment shown in FIG. 11 comprises two propellers 62 and 63, as above noted, that are attached to the propeller shaft 60. The motive force to drive the propellers 62 and 63 is provided by an internal combustion engine 160 that is located within the bilge of the marine vessel 22. The engine is configured with its crankshaft aligned for rotation about a horizontal axis. In one preferred embodiment, engine 160 is a diesel engine. Each of the two marine propulsion devices 54 and 64 is driven by a separate engine 160. In addition, each of the marine propulsion devices 54 and 64 are independently steerable about their respective steering axis 74 and 76. The steering axes are generally vertical and parallel to each other. They are intentionally not configured to be perpendicular to the bottom respective surface 30 and 32 of the hull. Instead, they are generally vertical and intersect the respective bottom surface 30 and 32 of the hull at an angle that is not equal to 90 degrees when the bottom surface of the hull is a V-type hull or any other shape which does not include a flat bottom. Driveshaft housings 56 and 66 and gear case torpedo housings 58 and 68 contain rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine. The marine vessel maneuvering system is one preferred embodiment is that provided in the noted commonly owned co-pending '482 and '483 applications, allowing the operator of the marine vessel to provide maneuvering commands to a microprocessor which controls the steering movements and thrust magnitudes of two marine propulsion devices 54, 64 to implement those maneuvering commands, e.g. steering, docking, and position or station maintaining virtual anchoring functions, and the like, as above noted.

It is recognized that various equivalents, alternatives and modifications are possible within the scope of the appended claims.

What is claimed is:

1. A marine vessel and drive combination comprising:

a marine vessel comprising a hull having a longitudinally extending keel having a lower reach and port and starboard lower hull surfaces extending upwardly and laterally distally oppositely from said keel in V-shaped relation;

a port tunnel formed in said port lower hull surface, said port tunnel having a top spaced above an open bottom;

a starboard tunnel in said starboard lower hull surface, said starboard tunnel having a top spaced above an open bottom;

a port marine propulsion device comprising a port drive shaft housing extending downwardly in said port tunnel to a port lower gear case supporting at least one port propeller shaft driving at least one port propeller;

a starboard marine propulsion device comprising a starboard driveshaft housing extending downwardly in said starboard tunnel to a starboard lower gear case supporting at least one starboard propeller shaft driving at least one starboard propeller;

wherein:

said port marine propulsion device is a steerable marine propulsion device steerable about a port steering axis which extends through said top of said port tunnel;

said starborad marine propulsion device is a steerable marine propulsion device steerable about a starboard steering axis which extends through said top of said starboard tunnel;

each of said port and starboard steering axes is vertical;

said port marine propulsion device provides propulsion thrust along a port thrust direction along at least one port propeller shaft, said port marine propulsion device having a port reference position with said port thrust direction pointing forwardly parallel to said keel, said port marine propulsion device being steerable about said port steering axis along a first angular range from said port reference position away from said keel, said port marine propulsion device being steerable about said steering axis along a second angular range from said port reference position towards said keel, said first and second angular ranges being unequal, and said port tunnel being asymmetric;

said starboard marine propulsion device provides propulsion thrust along a starboard thrust direction along said at least one starboard propeller shaft, said starboard marine propulsion device having a starboard reference position with said starboard thrust direction pointing forwardly parallel to said keel, said starboard marine propulsion device being steerable about said starboard steering axis along a third angular range from said starboard reference position towards said keel, said starboard marine propulsion device being steerable about said starboard steering axis along a fourth angular range from said starboard reference position away from said keel, said third and fourth angular ranges being unequal, and said starboard tunnel being asymmetric.

2. The marine vessel and drive combination according to claim 1 wherein:

said second angular range is at least twice as great as said first angular range;

said third angular range is at least twice as great as said fourth angular range.

3. The marine vessel and drive combination according to claim 2 wherein:

said first angular range is at least 15 degrees, and said second angular range is at least 45 degrees;

said third angular range is at least 45 degrees, and said fourth angular range is at least 15 degrees.

4. The marine vessel and drive combination according to claim 1 wherein:

said port tunnel has left and right port tunnel sidewalls extending vertically between said top of said port tunnel and said open bottom of said port tunnel at said port lower hull surface, said left and right port tunnel sidewalls being laterally spaced by said port driveshaft housing therebetween, said right port tunnel sidewall having a greater vertical height and lower vertical reach than said left port tunnel sidewall and limiting the span of one of said first and second angular ranges to be less than the span of the other of said first and second angular ranges;

said starboard tunnel has left and right starboard tunnel sidewalls extending vertically between said top of said starboard tunnel and said open bottom of said starboard tunnel at said starboard lower hull surface, said left and right starboard tunnel sidewalls being laterally spaced by said starboard driveshaft housing therebetween, said left starboard tunnel sidewall having a greater vertical height and a lower vertical reach than said right starboard tunnel sidewall and limiting the span of one of said third and fourth angular ranges to be less than the span of the other of said third and fourth angular ranges.

* * * * *